US009550956B2

(12) United States Patent
Kamata et al.

(10) Patent No.: US 9,550,956 B2
(45) Date of Patent: Jan. 24, 2017

(54) TWO-PHASE LUBRICATING OIL COMPOSITION

(75) Inventors: Kumiko Kamata, Kanagawa (JP); Ryuji Maruyama, Kanagawa (JP); Noriaki Shinoda, Chester (JP); Hiroyuki Tazaki, Kanagawa (JP)

(73) Assignee: SHELL OIL COMPANY, Houston, TX (US)

( * ) Notice: Subject to any disclaimer, the term of this patent is extended or adjusted under 35 U.S.C. 154(b) by 411 days.

(21) Appl. No.: 14/233,779

(22) PCT Filed: Jul. 10, 2012

(86) PCT No.: PCT/EP2012/063472

§ 371 (c)(1),
(2), (4) Date: Mar. 24, 2014

(87) PCT Pub. No.: WO2013/010851

PCT Pub. Date: Jan. 24, 2013

(65) Prior Publication Data

US 2014/0194332 A1 Jul. 10, 2014

(30) Foreign Application Priority Data

Jul. 21, 2011 (JP) ..... 2011-160351

(51) Int. Cl.
*C10M 173/02* (2006.01)
*C10M 141/02* (2006.01)
(Continued)

(52) U.S. Cl.
CPC ..... *C10M 141/02* (2013.01); *C10M 111/04* (2013.01); *C10M 169/04* (2013.01); *C10M 2203/1006* (2013.01); *C10M 2203/1025* (2013.01); *C10M 2205/0285* (2013.01); *C10M 2205/173* (2013.01); *C10M 2207/281* (2013.01); *C10M 2207/282* (2013.01); *C10M 2207/283* (2013.01); *C10M 2207/285* (2013.01); *C10M 2209/104* (2013.01); *C10M 2209/105* (2013.01); *C10M 2209/107* (2013.01); *C10M 2209/1045* (2013.01); *C10M 2209/1055* (2013.01); *C10M 2209/1075* (2013.01); *C10N 2220/022* (2013.01); *C10N 2220/032* (2013.01); *C10N 2230/02* (2013.01); *C10N 2230/56* (2013.01); *C10N 2230/70* (2013.01); *C10N 2240/02* (2013.01); *C10N 2240/04* (2013.01);
(Continued)

(58) Field of Classification Search
CPC ..... C10M 2207/129; C10M 2210/01
USPC ..... 508/532
See application file for complete search history.

(56) References Cited

U.S. PATENT DOCUMENTS 3,966,625 A 6/1976 Tanizaki et al.
4,370,247 A 1/1983 Ostyn

FOREIGN PATENT DOCUMENTS

EP 0355977 2/1990
EP 0524783 1/1993
(Continued)

*Primary Examiner* — Vishal Vasisth

(57) ABSTRACT

Lubricating oil compositions are provided herein that comprise a mixture of: (A) a hydrocarbon as a low-viscosity constituent, (B) a polyalkylene glycol (PAG) as a high-viscosity constituent wherein the oxygen/carbon weight ratio is in the range of from 0.450 to 0.580, and (C) a compound as a control constituent wherein the oxygen/carbon weight ratio is in the range of from 0.080 to 0.350. Methods of lubricating a surface using such lubricating compositions are also provided herein.

20 Claims, 2 Drawing Sheets

(51) Int. Cl.
*C10M 169/04* (2006.01)
*C10M 111/04* (2006.01)

(52) U.S. Cl.
CPC ..... *C10N 2240/08* (2013.01); *C10N 2240/10* (2013.01); *C10N 2240/30* (2013.01)

(56) References Cited

FOREIGN PATENT DOCUMENTS

| | | |
|---|---|---|
| EP | 0549253 | 6/1993 |
| EP | 1052282 | 11/2000 |
| WO | 9611244 | 4/1996 |

TWO-PHASE LUBRICATING OIL COMPOSITION

PRIORITY CLAIM

The present national stage application (§371) claims priority from PCT/EP2012/063472, filed Jul. 10, 2012, which claims priority from Japanese application 2011-160351, filed Jul. 21, 2011, which is incorporated herein by reference.

FIELD OF THE INVENTION

This invention relates to a lubricating oil composition. In more detail, it relates to a two-phase lubricating oil composition.

BACKGROUND OF THE INVENTION

Normally, the viscosity of a lubricating oil decreases as the temperature rises. For this reason, the viscosity is generally high at low temperatures and low at high temperatures. The types of lubricating oils even differ according to the environment (especially temperature) in which they are used. In the case of lubricating oils used in both low-temperature environments and high-temperature environments, if they are low-viscosity types, loss of oil film may occur because the viscosity is too low at high temperatures, and they may not serve their function as a lubricating oil. On the other hand, if they are high-viscosity types, the viscosity at low temperatures may be too high and churning losses may increase, and pump feeds of oil may not work, giving rise to problems of seizure and wear.

It is important that viscosity is low at activation start-up times (when switching from a stopped state to a working state, that is, at low temperatures). This is because, if viscosity is high at such activation start-up times, an initial starting force is necessary to go from the stopped state to the working state. On the other hand, once the machinery has started working, viscosity becomes irrelevant. If the machinery continues working, the machinery acquires heat, and its temperature rises (for example, to about 100° C.). When a high temperature is reached, there is a possibility, as mentioned above, that the viscosity falls too much and the oil film is broken.

It is difficult to maintain the necessary viscosity in wide-ranging temperature conditions with just a single lubricating oil. WO96/11244 has therefore disclosed a lubricating oil which, by virtue of combining a low-viscosity lubricating oil and a high-viscosity lubricating oil, uses only the characteristics of the low-viscosity lubricating oil at low temperatures and makes use of the feature that viscosity rises by having a high-viscosity lubricating oil mix with the low-viscosity lubricating oil at high temperatures, so that it functions at both low temperatures and high temperatures.

However, in the method described in WO96/11244 there is an issue in that the separation temperature and the kinematic viscosity are undoubtedly determined by the kinds and ratios of the oils combined and it can be hard to produce the characteristics required by the application.

SUMMARY OF THE INVENTION

According to the present invention, there is provided a lubricating oil composition comprising:

(A) a hydrocarbon as a low-viscosity constituent, (B) a polyalkylene glycol (PAG) as a high-viscosity constituent wherein the oxygen/carbon weight ratio is in the range of from 0.450 to 0580, and (C) a compound as a control constituent wherein the oxygen/carbon weight ratio is in the range of from 0.080 to 0.350.

According to another aspect of the present invention there is provided a lubricating oil composition which contains (A) a hydrocarbon as a low-viscosity constituent, (B) a polyalkylene glycol (PAG) as a high-viscosity constituent wherein the oxygen/carbon weight ratio is in the range of from 0.450 to 0.580, and (C) a compound as a control constituent wherein the oxygen/carbon weight ratio is in the range of from 0.080 to 0.350, and which incorporates in the mixture a control constituent capable of reducing the separation temperature of said composition as desired.

According to this invention, an effect is achieved whereby it can be used in various lubricating applications where different characteristics are required, because, by using as a control constituent a compound in which the oxygen/carbon weight ratio is in the range of from 0.080 to 0.350 added to a hydrocarbon, which is the low-viscosity constituent, and a polyalkylene glycol (PAG), which is the high-viscosity constituent in which the oxygen/carbon weight ratio is in the range of from 0.450 to 0.580, it becomes possible, compared with a system in which no control constituent is present, to lower the separation temperature and also to maintain the kinematic viscosity at almost the same level at high temperatures.

DETAILED DESCRIPTION OF THE INVENTION

Figure 1:
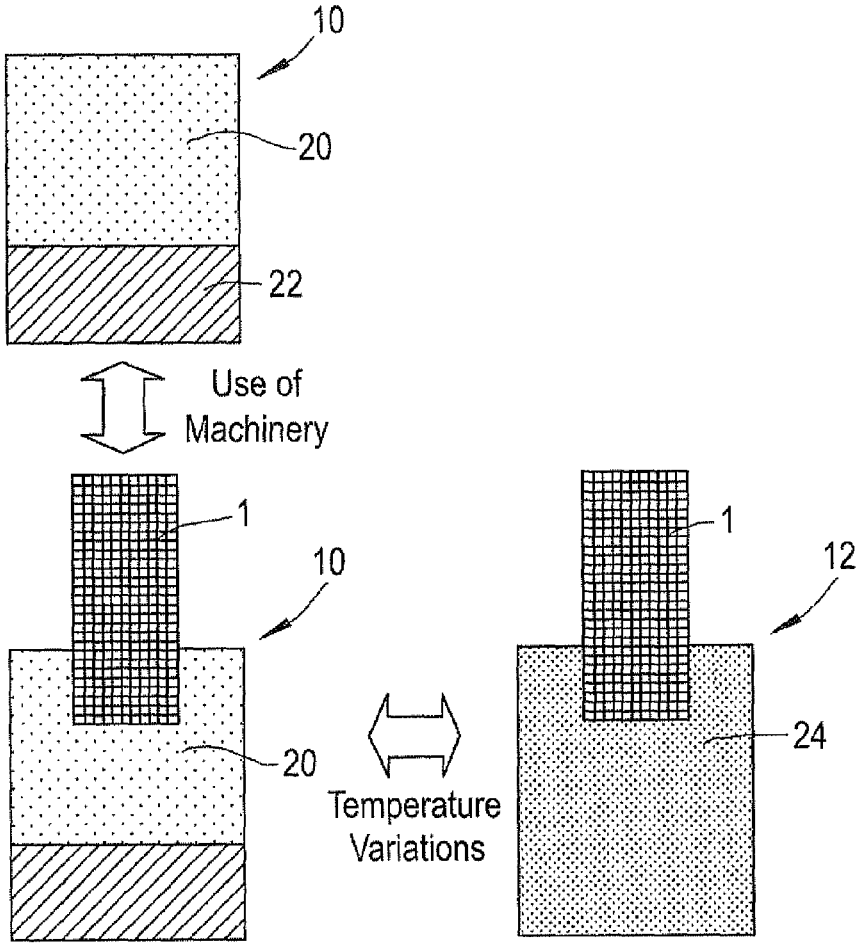
FIG. 1 shows a schematic drawing of the two-phase system of this invention.

The invention is explained in detail below, but it is not in any way limited to such specific applications, and needless to say it can be applied over a wide range of applications as desired.

The lubricating oil composition of this invention contains a low-viscosity constituent, a high-viscosity constituent, and a control constituent which has in-between characteristics. An explanation is given below for each of these constituents used as effective constituents. Then an explanation is given for the lubricating oil composition.

(A) Low-Viscosity Constituent (Hydrocarbon)

In the lubricating oil composition of this invention a hydrocarbon is used as the low-viscosity constituent. A hydrocarbon pertaining to this invention herein refers to a hydrocarbon which can be used as a base oil for a lubricating oil by the relevant industry. α-olefins are compounds with C—C double bonds at the terminals, and they are exemplified by examples such as ethylene, propylene, butene, isobutene, butadiene, hexene, cyclohexene, methylcyclohexene, octene, nonene, decene, dodecene, tetradecene, hexadecene, octadecene and eicosene. These compounds may be used singly or in mixtures of two or more kinds. Also, so long as these compounds have C—C double bonds at the terminals, they may have whatever structures such as isomer structures they can adopt, and they may also be branched or linear structures. It is possible to combine use of two or more kinds of these structural isomers or doublebond positional isomers. In the case of these olefins, use of straight-chain olefins with 6 to 30 carbons is preferred.

For this invention, commercial products such as Durasyn (INEOS Co.), SpectraSyn (Exxon Mobil Co.) and LUCANT (Mitsui Petrochemical Co.) can be procured.

In addition, it is possible also to use ordinary mineral oils as the low-viscosity constituent. As examples of minerals oils, mention may be made of paraffinic or naphthenic mineral oils obtained by use of an appropriate combination of one or two or more kinds of refining procedures on lubricating oil fractions obtained by atmospheric and vacuum distillation of crude oil, such as solvent deasphalting, solvent extraction, solvent dewaxing, catalytic dewaxing, hydro-refining, sulphuric acid washing and clay treatments.

It is also possible to use a GTL (gas to liquid) base oil synthesised by the Fischer-Tropsch process which is a technique for making liquid fuels from natural gas. A GTL base oil has very low sulphur and aromatics components compared to mineral oil base oils refined from crude oil, and because the paraffin constituents ratio is very high, it has superior oxidation stability, and because evaporation losses are also very small it can be used satisfactorily as a base oil for the invention.

The 40° C. kinematic viscosity of the hydrocarbon which is the low-viscosity constituent pertaining to this invention is in the range of from 5 to 500 $mm^2/s$, but preferably in the range of from 5 to 50 $mm^2/s$ and more preferably in the range of from 5 to 25 $mm^2/s$. The 100° C. kinematic viscosity is in the range of from 1.1 to 50 $mm^2/s$, but preferably in the range of from 1.5 to 10 $mm^2/s$ and more preferably in the range of from 1.5 to 5 $mm^2/s$. Also, the density of the hydrocarbon which is the low-viscosity constituent pertaining to this invention is preferably in the range of from 0.750 to 0.950 $g/cm^3$, more preferably in the range of from 0.750 to 0.910 $g/cm^3$ and even more preferably in the range of from 0.790 to 0.850 $g/cm^3$. Two or more kinds of low-viscosity constituent may also be used in combination.

(B) High-Viscosity Constituent (Polyalkylene Glycols (PAG) in which the Oxygen/Carbon Weight Ratio is from 0.450 to 0.580)

This invention uses as the high-viscosity constituent used together with the hydrocarbon of the aforementioned low-viscosity constituent a polyalkylene glycol (PAG) in which the oxygen/carbon weight ratio at which it essentially does not mix with the low-viscosity constituent at low temperatures but does mix at high temperatures is in the range of from 0.450 to 0.580, but preferably in the range of from 0.450 to 0.500 and more preferably in the range of from 0.450 to 0.470.

The oxygen/carbon weight ratio here denotes the proportion of the amount by weight of oxygen relative to the amount by weight of carbon in a constituent. This value influences properties such as mainly the density and polarity of the compound. For example, in the case of polarity, it is influenced by the kinds of functional groups such as ether groups, ester groups, hydroxyl groups and carboxyl groups, and, in the case of oxygen atoms, given that they have high electro-negativity, the general tendency is for polarity to increase as the oxygen/carbon weight ratio becomes larger. As regards density, given that oxygen is heavier than carbon, compounds where the oxygen/carbon weight ratio is large will generally tend to have a high density. Measurement of the oxygen/carbon weight ratio can be carried out in accordance with JPI-5S-65 (Petroleum Products—Determination of Carbon, Hydrogen and Nitrogen Components) and JPI-5S-68 (Petroleum Products—Determination of Oxygen Component).

As examples of the polyalkylene glycols (PAG) used in the lubricating oil composition of this invention and in which the oxygen/carbon weight ratio is in the range of from 0.450 to 0.580, mention may be made of those described by the following general formulas (1) to (4).

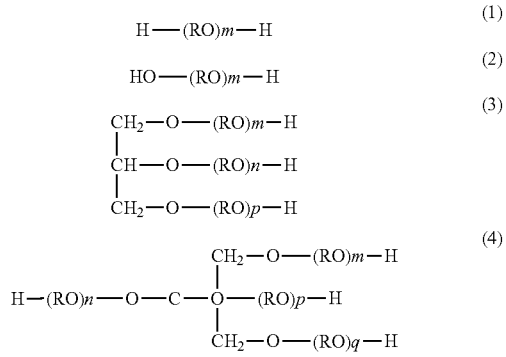

In the formulae above, each R is independent and denotes a C2-C10, but preferably a C2-C8 and more preferably a C2-C6, linear or branched hydrocarbon group, and m is an integer in the range of from 2 to 500 but preferably in the range of from 2 to 400 and more preferably in the range of from 2 to 300. For any R, it is not necessary for it to be a single alkylene; it may be a combination of different alkylenes. As specific examples, in the case of a block copolymer with the aforementioned $(R^1O)_m$ being two kinds of alkylene oxide, the aforementioned $(R^1O)$, may be designated as $(R^{1-1}O)_{m-1}$ $(R^{1-2}O)_{m-2}$.

As examples of polyalkylene glycols (PAG) in which the oxygen/carbon weight ratio is in the range of from 0.450 to 0.580, mention may be made of those obtained by addition polymerisation of alkylene oxides in alcohols. The alkylene oxide starting material may be one kind or two or more kinds. As examples of the added monomers, mention may be made of ethylene oxide, propylene oxide or butylene oxide alone, or combinations of two or more kinds thereof (for example, ethylene oxide/propylene oxide).

The polyalkylene glycols (PAG) pertaining to this invention and in which the oxygen/carbon weight ratio is in the range of from 0.450 to 0.580 have a 100° C. kinematic viscosity in the range of from 2.5 to 100 $mm^2/s$, but preferably in the range of from 2.5 to 80 $mm^2/s$ and more preferably in the range of from 2.5 to 70 $mm^2/s$. Further, the aforementioned polyalkylene glycols (PAG) pertaining to this invention have a density in the range of from 1.000 to 1.050 $g/cm^3$, but preferably in the range of from 1.000 to 1.020 $g/cm^3$ and more preferably in the range of from 1.000 to 1.010 $g/cm^3$. They may also be used by combining two or more kinds of high-viscosity constituent.

(C) Control Constituent (Compound in which the Oxygen/Carbon Weight Ratio is 0.080 to 0.350)

In the lubricating oil composition of this invention, a compound which has an oxygen/carbon weight ratio in the range of from 0.080 to 0.350, but preferably in the range of from 0.080 to 0.300 and more preferably in the range of from 0.080 to 0.250, is used as a control constituent. What is meant by a control constituent is a constituent that, in its presence, even though the low-viscosity constituent and high-viscosity constituent essentially do not mix together at low temperatures, at high temperatures it promotes their mixing into a uniform state. It is also possible to use two or more kinds of control constituent in combination. The control constituent herein is not specially limited so long as it is a compound with the aforementioned oxygen/carbon weight ratio, but from the standpoints of polarity and viscosity, compounds containing ester groups (ester compounds) are ideal examples. For compounds containing ester groups it is ideal to use aliphatic ester compounds having a linear or branched hydrocarbon portion and an ester functional group, or aromatic ester compounds having an aromatic portion and an ester functional group, or the like. Most preferred are aliphatic ester compounds having as their constituent elements only carbon, hydrogen and oxygen (for example, aliphatic ester compounds in which the carbon chain other than in the ester group is C4 to C18, preferably C4 to C16, and more preferably C4 to C14) and/or aromatic ester compounds.

Monoesters, diesters and triesters are preferably used for the aforementioned ester compounds. Diesters are more preferable. As examples of monoesters, mention may be made of esters of monocarboxylic acids (for example, formic acid, acetic acid, propionic acid, butyric acid, valeric acid, caproic acid, enanthic acid, caprylic acid, pelargonic acid, capric acid, undecylic acid, lauric acid, tridecylic acid, hexadecylic acid, heptadecylic acid and stearic acid) and monohydric alcohols (for example, linear or branched monohydric alcohols such as methanol, ethanol, propanol, butanol, pentanol, hexanol, heptanol, octanol, nonanol and decanol). As examples of diesters, mention may be made of esters of dicarboxylic acids (for example, linear or branched dicarboxylic acids such as malonic acid, succinic acid, adipic acid, pimeric acid, suberic acid, azelaic acid and sebacic acid) and monohydric alcohols (for example, the monohydric alcohols mentioned above), or esters of monocarboxylic acids (for example, the monocarboxylic acids mentioned above) and dihydric alcohols (for example, linear or branched dihydric alcohols such as ethylene glycol, propylene glycol, butylene glycol, pentylene glycol and hexylene glycol). As examples of triesters, mention may be made of esters of monocarboxylic acids (for example, the monocarboxylic acids mentioned above) and trihydric alcohols (for example, linear or branched trihydric alcohols such as glycerol and butanetriol), or esters of tricarboxylic acids (for example, citric acid and isocitric acid) and monohydric alcohols (for example, the monohydric alcohols mentioned above). Specifically, fatty acid diesters [for example, diisononyl adipate (commercial name ETNA, by Taoka Chemical Co.)] fatty acid monoesters [for example, isooctyl stearate (commercial name Exeparl EH-S, by Kao Corp.)], trimellitic esters [for example, tri-normal-alkyl trimellitate (commercial name Trimex N-08, by Kao Corp.)], and fatty acid triesters [for example, trimethylolpropyl oleate (commercial name Kaolube 190, by Kao Corp.)] are ideal for use.

The compound which is used for the control constituent pertaining to this invention and which has an oxygen/carbon weight ratio in the range of from 0.080 to 0.350 will be one that has a 40° C. kinematic viscosity in the range of from 5 to 75 $mm^2/s$, but preferably in the range of from 7 to 60 $mm^2/s$ and more preferably in the range of from 9 to 50 $mm^2/s$, a 100° C. kinematic viscosity in the range of from 2.5 to 18 $mm^2/s$, but preferably in the range of from 2.7 to 15 $mm^2/s$ and more preferably in the range of from 2.8 to 10 $mm^2/s$, and a density in the range of from 0.800 to 1.010 $g/cm^3$, but preferably in the range of from 0.830 to 1.005 $g/cm^3$ and more preferably in the range of from 0.850 to 1.000 $g/cm^3$.

Optional Additives

It is possible, as required, to use in the lubricating oil composition of this invention, one kind or more of optional additives such as anti-wear agents, rust preventatives, metal deactivators, anti-hydrolysis agents, anti-static agents, defoamers, anti-oxidants, dispersants, detergents, extreme pressure additives, friction modifiers, viscosity index improvers, pour point depressants, tackifiers, metallic detergents, ashless dispersants and corrosion inhibitors. For example, it is possible to use "additives packages" to improve performance (for example, various packages such as the ATF additives package).

Relative to the total weight (100% by weight) of the lubricating oil composition, the lubricating oil composition of this invention contains preferably from 30 to 80% by weight, but more preferably 40 to 80% by weight and even more preferably from 50 to 80% by weight, of (A) a hydrocarbon which is a low-viscosity constituent, preferably from 3 to 35% by weight, but more preferably from 7.5 to 30% by weight and even more preferably from 10 to 25% by weight, of (B) a polyalkylene glycol (PAG) which is a high-viscosity constituent wherein the oxygen/carbon weight ratio is in the range of from 0.450 to 0.580, and preferably from 1 to 30% by weight, but more preferably from 2 to 25% by weight and even more preferably from 3 to 20% by weight of (C) a compound which is a control constituent wherein the oxygen/carbon weight ratio is in the range of from 0.080 to 0.350. In addition, it may contain, for example, from 1 to 25% by weight of optional substances, relative to the total weight of the lubricating oil composition.

In the lubricating oil composition of this invention, the low-viscosity constituent and the high-viscosity constituent at low temperatures separate into two phases by virtue of a control constituent, the oxygen/carbon weight ratio of which is in the range of from 0.080 to 0.350, having been added. As the temperature rises, the low-viscosity constituent and the high-viscosity constituent mix together and at or above the separation temperature both become a single phase. Normally, given that the machinery which is the target of the lubrication comes into contact close to the liquid surface of the lubricating oil, the viscosity of the low-viscosity constituent, which preferably is normally in the upper phase, contributes at low temperatures, and the kinematic viscosity at 40° C. is preferably in the range of from 5 to 500 $mm^2/s$, but more preferably in the range of from 8 to 400 $mm^2/s$ and even more preferably in the range of from 10 to 300 $mm^2/s$. Here, the 40° C. kinematic viscosity has as its object of measurement the upper phase of the lubricating oil composition which is in two phases, but what is used is the case when the lubricating oil composition has already been heated and made uniform and has then been cooled, separating into two phases. Therefore, it may be that a portion of the control constituent has mixed into the low-viscosity constituent as a result of having gone through heating and cooling. On the other hand, the viscosity of the mixture in which the low-viscosity constituent and the high-viscosity constituent have become uniform contributes at high temperatures, and the kinematic viscosity at 100° C. is preferably in the range of from 1.5 to 100 $mm^2/s$, but more preferably in the range of from 2.0 to 20 $mm^2/s$ and even more preferably in the range of from 2.5 to 15 $mm^2/s$.

The apparent viscosity index (VI) of the lubricating oil composition of this invention is preferably in the range of from 50 to 1000, but more preferably in the range of from 200 to 800 and even more preferably in the range of from 300 to 800. What is meant by the viscosity index is a suitable index which shows the extent of viscosity change in the lubricating oil which occurs due to temperature change. The viscosity index in this invention can be calculated on the basis of the kinematic viscosity at 40° C. of the sample oil (upper phase after separation into two phases) and the kinematic viscosity at 100° C. of the sample oil (the lubricating oil composition having become uniform) according to the method of calculating the viscosity index stipulated in JISL2283. When the viscosity index is high, it means that the change in viscosity in respect of a change in temperature is small.

In this invention, it is possible, by adding a control constituent in which the oxygen/carbon weight ratio is in the range of from 0.080 to 0.350, to control the separation temperature of the lubricating oil composition to any temperature desired. This invention therefore offers a method of controlling the separation temperature of the lubricating oil composition.

As mentioned above, the lubricating oil composition of this invention has a separation temperature at which there is a shift between a one-phase state and a two-phase state. What is meant by separation temperature herein is the temperature at which, after turning the lubricating oil composition, which was in a two-phase state, into a one-phase state by heating it, cloudiness (precipitation) becomes apparent upon cooling. The lubricating oil composition of the invention preferably is mixed so that the high-viscosity constituent increases the viscosity of the low-temperature constituent in the high-temperature domain (more preferably, the low-viscosity constituent and the high-viscosity constituent become uniform). The ideal lubricating oil composition of this invention is separated into two phases at 40° C. and becomes one phase (uniform) at 100° C., and it is possible to control it to any desired separation temperature.

The control constituent, ideally, has the function whereby it controls the separation temperature at which there is a shift from one phase to two phases to a desired value in the range of from 40° C. to 100° C. in a lubricating oil which separates into two phases at 40° C. and becomes a single phase (uniform) at 100° C. Also, at low temperatures, a portion or all of the control constituent may be mixed into the upper phase and/or lower phase, or alternatively it may be present as a separate phase. What this means is that if, at low temperatures, the control constituent is mixed in the upper phase and/or lower phase, it still functions as a viscosity-changing constituent of the low-viscosity constituent which is the main component of the upper phase and the high-viscosity constituent which is the main component of the lower phase. For example, if, under circumstances where the control constituent is mixed in the upper and lower phases at low temperature, the viscosities are low-viscosity constituent<control constituent<high-viscosity constituent, the viscosity of the low-viscosity constituent which is the main component of the upper phase<the viscosity of the upper phase, and the viscosity of the lower phase<the viscosity of the high-viscosity constituent which is the main component of the lower phase.

Examples Using Actual Lubricating Oils

First of all, an explanation is given for examples of the invention at start-up during use of machinery, with reference to FIG. 1. FIG. 1 (top diagram) is a form of embodiment of the lubricating oil composition of this invention, and shows a two-phase state 10 which is in a low-temperature state. The low-viscosity constituent 20 is located in the upper phase since it is a low-density lubricating oil, and the high-viscosity constituent 22 is located in the lower phase since it is a high-density lubricating oil. FIG. 1 (lower left diagram) is an embodiment using a machine 1 which is being lubricated, and the machine is immersed in the upper phase of the lubricating oil composition. During start-up (low temperature), the low-viscosity upper phase 20 is the main contributor to lubrication and the high-viscosity lower phase 22 hardly contributes to lubrication at all. At low temperatures, the low-viscosity lubricating oil has sufficient performance (viscosity) for lubrication, and so no impediment to lubrication performance is caused by it being a low-viscosity constituent alone. FIG. 1 (lower right diagram) shows the single-phase state 12 once a high temperature has been reached as the result of continuous use. Here, because of the rise in temperature, the high-viscosity constituent 22 mixes with the low-viscosity constituent 20 and a uniform lubricating oil composition 24 results. The high-viscosity constituent 22 compensates for the reduction in viscosity that accompanies the rise in temperature of the low-viscosity constituent 20, through the fact that the high-viscosity constituent 22 is mixed in after the period in which the low-viscosity constituent 20 acts alone, and so no impediments such as breaking of the oil film occur even if a high temperature is reached. Through obtaining a uniform, single-phase system at a temperature at or above the separation temperature, the high-viscosity constituent compensates for the reduction in viscosity of the low-viscosity constituent.

One feature of this invention is the behaviour of the lubricating oil composition in which a low-viscosity constituent and a high-viscosity constituent are mixed together. Specifically, a low-viscosity lubricating oil such as a hydrocarbon, which would normally be in the upper phase, contributes to lubrication at low temperatures, and a mixture of a high-viscosity lubricating oil and a low-viscosity lubricating oil contributes at high temperatures. In such cases, by using a control constituent as in the invention, it is possible to maintain the kinematic viscosity at high temperatures at almost the same level even while reducing the separation temperature. On the other hand, if the method used is simply to change the proportions of low-viscosity constituent and high-viscosity constituent as in WO96/11244, no relationship ever becomes apparent between the kinematic viscosities and the separation temperature, so that it is extremely difficult to establish kinematic viscosities and a separation temperature according to the purpose or the environment of the application.

Applications

There are no special restrictions, and the lubricating oil composition of this invention can be used as the lubricating oil of various kinds of machinery. For example, it can be used for lubrication of the rotating and sliding members of various kinds of vehicles and industrial machines. In particular, it can be used as the lubricating oil in instances used in a low-temperature (for example −40° C.) to high-temperature (for example 120° C.) domain such as automotive engines (diesel engines, petrol engines and so on), speed-change mechanisms (gearboxes, CVT, AT, MT, DCT, diff and so on), industrial uses (construction machinery, agricultural machinery, factory machinery, gearboxes and so on), bearings (turbines, spindles, machine tools and so on), hydraulic apparatus (oil-actuated cylinders, door checks and so on) and compression apparatus (compressors, pumps and so on).

In the lubricating oil composition of this invention the viscosity differs according to the requirements of the application, and, in the case of an engine oil for example, the 100° C. kinematic viscosity may be in the range of from 5 to 14

$mm^2/s$, but preferably in the range of from 5 to 12 $mm^2/s$ and more preferably in the range of from 5.5 to 11 $mm^2/s$. In the case of a manual gear-change the 100° C. kinematic viscosity may be in the range of from 6 to 15 $mm^2/s$, but preferably in the range of from 6 to 13 $mm^2/s$ and more preferably in the range of from 6 to 11 $mm^2/s$. In the case of an automatic gearbox 100° C. kinematic viscosity may be in the range of from 4 to 8.5 $mm^2/s$, but preferably in the range of from 4 to 7.5 $mm^2/s$ and more preferably in the range of from 4 to 6.5 $mm^2/s$.

EXAMPLES

Below, the invention is explained by means of examples, but it is not limited to the following examples.

Test Methods

Measurements of Various Kinds of Data

Various kinds of data for the lubricating oil composition of this invention and the lubricating oil compositions of the comparative examples were measured by the following methods.

[1] Separation Temperature

The separation temperature was measured by using a Corning PC-420D as the heater.

(1) 50 g of sample was put in a 100 ml beaker, and the stirrer 100 was introduced.

Figure 2:
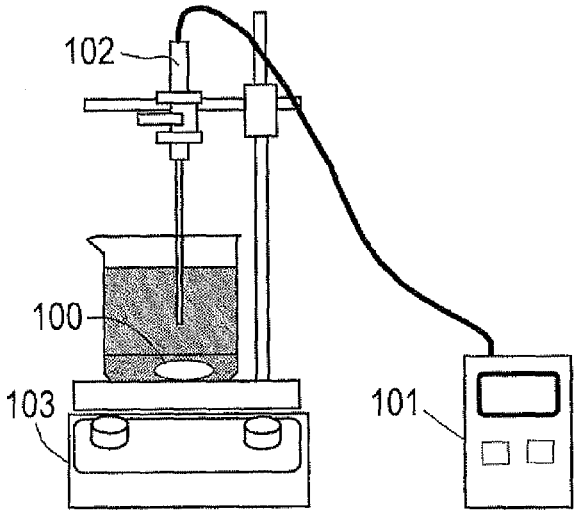
FIG. 2 shows an example of measurement of the separation temperature of a lubricating oil composition in this invention.

(2) The experimental apparatus was set up as in FIG. 2, and a thermocouple 102 for use in measuring the oil temperature which was connected to a thermometer 101 was inserted in the oil.

(3) The agitation speed of the hot stirrer 103 was set at 300 rpm.

(4) The plate temperature was set at 200° C. and the oil temperature was heated to 120° C.

(5) Once the oil temperature had reached 120° C., heating was terminated and the sample was cooled to approximately room temperature.

(6) The oil temperature was heated to 120° C. following the same procedure as in (4).

(7) Once the oil temperature had reached 120° C., heating was terminated and the state of the sample in the beaker was examined.

(8) When cloudiness of the sample in the beaker occurred (when precipitation was apparent), the oil temperature was recorded and noted as the separation temperature. The method of measurement was visual inspection but measurement of the aniline point (JIS K 2256) was used as a reference.

[2] Kinematic Viscosity (40° c.)

The sample for which the separation temperature was measured in [1] was used. Measurement of the kinematic viscosity (40° C.) used an Ubbelohde viscometer as the test apparatus and was carried out in accordance with JIS K 2283. Because separation into two phases was possible at the measurement temperature, the supernatant portion of the upper phase (where the low-viscosity constituent was the main component) was taken and made the sample for the viscosity measurement.

[3] Kinematic Viscosity (100° c.)

As in [2], the sample for which the separation temperature was measured in [1] was used. Measurement of the kinematic viscosity (100° C.) used an Ubbelohde viscometer as the test apparatus and was carried out in accordance with JIS K 2283. Measurement was performed by putting the sample in a viscosity tube preheated to 100° C., inserting in the bath before the temperature decreased.

[4] Apparent Viscosity Index (Apparent VI)

The apparent VI (viscosity index) was calculated from the aforementioned 40° C. and 100° C. kinematic viscosities in accordance with KIS K 2283. The apparent VI differs from the normal VI, and is measured by using the supernatant where the 40° C. kinematic viscosity is for a portion of the composition.

[5] Density (15° C.)

Measurement of the density (15° C.) was carried out in accordance with JIS K 2249 by using an oscillating type test apparatus (Kyoto Electronics Manufacturing Co.: DA-300)

[6] Oxygen/Carbon Weight Ratio

The oxygen/carbon weight ratio (proportion of amount of oxygen by weight relative to amount of carbon by weight) was measured in accordance with JPI-5S-65 (Petroleum Products—Determination of Carbon, Hydrogen and Nitrogen Components) and JPI-5S-68 (Petroleum Products—Determination of Oxygen Component), using as the test apparatus a vario EL III made by Elementar Co.

Examples and Comparative Examples

Lubricating oil compositions using the following constituents were prepared for the examples and comparative examples below. Unless specially mentioned, the amounts denote parts by weight. The constituents used in the examples and comparative examples were as follows.

[1] Low-Viscosity Constituent

The following base oils 1 to 6 were used for the low-viscosity constituent. The oxygen/carbon weight ratio of all these was 0 (through not containing oxygen atoms).

(1) "Base oil 1" was a Gp II mineral oil (commercially available from S Oil under the tradename Ultra S-2) which had a density at 20° C. of 0.8198 $g/cm^3$, and kinematic viscosities of 7.65 $mm^2/s$ at 40° C. and 2.28 $mm^2/s$ at 100° C.

(2) "Base oil 2" was a Gp IV synthetic oil (commercially available from INEOS under the tradename Durasyn 162) which had a density at 20° C. of 0.7972 $g/cm^3$, and kinematic viscosities of 5.75 $mm^2/s$ at 40° C. and 1.85 $mm^2/s$ at 100° C. (ordinary name PAO2).

(3) "Base oil 3" was a Gp III mineral oil (paraffin base oil) (commercially available from SK Lubricants under the tradename Yubase 4) which had a density at 20° C. of 0.8326 $g/cm^3$, and kinematic viscosities of 19.38 $mm^2/s$ at 40° C. and 4.25 $mm^2/s$ at 100° C.

(4) "Base oil 4" was a Gp IV synthetic oil (commercially available from Exxon Mobil Chemicals under the tradename Spectra Syn 4) which had a density at 20° C. of 0.8189 $g/cm^3$, and kinematic viscosities of 17.57 $mm^2/s$ at 40° C. and 3.96 $mm^2/s$ at 100° C.

(5) "Base oil 5" was a Gp IV mineral oil (commercially available from Mobil under the tradename SHF41) which had kinematic viscosities of 17.25 $mm^2/s$ at 40° C. and 3.88 $mm^2/s$ at 100° C. (ordinary name PAO4).

[2] Additives

For the additives, an ATF additives package was blended with the control constituent. An "additives package" is a special package to improve performance of transmission fluids, and is a package that contains a combination of performance-enhancing additives including friction improvers, anti-oxidants, anti-rust agents, anti-wear agents, dispersants and detergents.

[3] Control Constituent

The following esters 1 to 4 were used for the control constituent.

(1) "Ester 1" was a fatty acid diester (diisononyl adipate commercially available from Taoka under the tradename DINA) which had a density at 20° C. of 0.924 g/cm$^3$, an oxygen/carbon weight ratio of 0.221 and kinematic viscosities of 10.81 mm$^2$/s at 40° C. and 3.042 mm$^2$/s at 100° C.

(2) "Ester 2" was a fatty acid monoester (isooctyl stearate, commercially available from Kao under the tradename Exeparl EH-S) which had a density at 20° C. of 0.8577 g/cm$^3$, an oxygen/carbon weight ratio of 0.0969 and kinematic viscosities of 9.701 mm$^2$/s at 40° C. and 2.928 mm$^2$/s at 100° C.

(3) "Ester 3" was a trimellitic ester (tri-normal-alkyl trimellitate, commercially available from Kao under the tradename Trimex N-08) which had a density at 20° C. of 0.982 g/cm$^3$, an oxygen/carbon weight ratio of 0.219 and kinematic viscosities of 45.81 mm$^2$/s at 40° C. and 7.272 mm$^2$/s at 100° C.

(4) "Ester 4" was a fatty acid triester (trimethylolpropyl oleate, commercially available from Kao under the tradename Kaolube 190) which had a density at 20° C. of 0.918 g/cm$^3$, an oxygen/carbon weight ratio of 0.128 and kinematic viscosities of 49.21 mm$^2$/s at 40° C. and 9.816 mm$^2$/s at 100° C.

[4] High-Viscosity Constituent

The following polyalkylene glycols were used for the high-viscosity constituent.

(1) "PAG 1" was a polyalkylene glycol (marketed as Nichiyu MB-14) which had a density at 20° C. of 0.995 g/cm$^3$, an oxygen/carbon weight ratio of 0.428 and kinematic viscosities of 73.4 mm$^2$/s at 40° C. and 13.75 mm$^2$/s at 100° C.

(2) "PAG 2" was a polyalkylene glycol (marketed as Nichiyu MB-22) which had a density at 20° C. of 1.000 g/cm$^3$, an oxygen/carbon weight ratio of 0.446 and kinematic viscosities of 125 mm$^2$/s at 40° C. and 22.13 mm$^2$/s at 100° C.

(3) "PAG 3" was a polyalkylene glycol ethylene oxide+propylene oxide (marketed as Nichiyu MB-38) which had a density at 20° C. of 1.002 g/cm$^3$, an oxygen/carbon weight ratio of 0.451 and kinematic viscosities of 227 mm$^2$/s at 40° C. and 36.28 mm$^2$/s at 100° C.

(4) "PAG 4" was a polyalkylene glycol ethylene oxide+propylene oxide (marketed as Nichiyu MB-700) which had a density at 20° C. of 1.003 g/cm$^3$, an oxygen/carbon weight ratio of 0.451 and kinematic viscosities of 616 mm$^2$/s at 40° C. and 92.73 mm$^2$/s at 100° C.

(5) "PAG 5" was a polyalkylene glycol ethylene oxide+propylene oxide (marketed as Dow Chemical P4000) which had a density at 20° C. of 1.006 g/cm$^3$, an oxygen/carbon weight ratio of 0.453 and kinematic viscosities of 398 mm$^2$/s at 40° C. and 62.23 mm$^2$/s at 100° C.

(6) "PAG 6" was a polyalkylene glycol ethylene oxide+propylene oxide (marketed as from Nichiyu TG-4000) which had a density at 20° C. of 1.008 g/cm$^3$, an oxygen/carbon weight ratio of 0.460 and kinematic viscosities of 321.4 mm$^2$/s at 40° C. and 47.17 mm$^2$/s at 100° C.

(7) "PAG 7" was a polyalkylene glycol ethylene oxide+propylene oxide (marketed as Nichiyu D-250) which had a density at 20° C. of 1.019 g/cm$^3$, an oxygen/carbon weight ratio of 0.578 and kinematic viscosities of 23 mm$^2$/s at 40° C. and 3.215 mm$^2$/s at 100° C.

(8) "PAG 8" was a polyalkylene glycol ethylene oxide+propylene oxide (marketed as Nichiyu 50 MB-72) which had a density at 20° C. of 1.058 g/cm$^3$, an oxygen/carbon weight ratio of 0.550 and kinematic viscosities of 397 mm$^2$/s at 40° C. and 71.07 mm$^2$/s at 100° C.

(9) "PAG 9" was a polyalkylene glycol (marketed as Nichiyu PEG400) which had a density at 20° C. of 1.13 g/cm$^3$, an oxygen/carbon weight ratio of 0.760 and kinematic viscosities of 40.6 mm$^2$/s at 40° C. and 7.316 mm$^2$/s at 100° C.

(10) "PAG 10" was a polyalkylene glycol (commercially available from Rhein Chemie under the tradename Baylube 150GL) which had a density at 75° F. of 1.00 g/cm$^3$, and kinematic viscosities of 143 mm$^2$/s at 40° C. and 22.6 mm$^2$/s at 100° C.

Example 1

Various samples of lubricating oil composition were prepared by weighing out into a beaker, in order, the high-viscosity constituents, additives, control constituents and low-viscosity constituents as shown below, and mixing them. Table 1 shows the compositions of combinations using Base oil 1 as the low-viscosity constituent, a PAG as the high-viscosity constituent, and Ester 1 as the control constituent, as well as the separation temperature and the kinematic viscosities (40° C. and 100° C.). The amounts of the various components in the lubricating oil compositions in Table 1 (and in Tables 2-5) are expressed in wt % unless otherwise specified.

TABLE 1

| | | 1-1 | 1-2 | 1-3 | 1-4 | 1-5 | 1-6 | 1-7 | 1-8 |
|---|---|---|---|---|---|---|---|---|---|
| Low-viscosity constituent | Base oil 1 | 50 | 65 | 70 | 50 | 65 | 50 | 65 | 70 |
| Additives package | | 10 | 10 | 10 | 10 | 10 | 10 | 10 | 10 |
| Control constituent | Ester 1 | 20 | 5 | 0 | 20 | 5 | 20 | 5 | 0 |
| High-viscosity constituent | PAG 4 | 20 | 20 | 20 | | | | | |
| | PAG 5 | | | | | | 20 | 20 | 20 |
| | PAG 7 | | | | 20 | 20 | | | |
| Separation temperature (° C.) | | 50.7 | 57.5 | 68.5 | 69.0 | 100.0 | 49.1 | 67.2 | 76.8 |
| Kinematic viscosity @ 40° C. (mm$^2$/s) | | 18.48 | 11.89 | 10.82 | 10.87 | 10.32 | 16.15 | 11.67 | 10.64 |
| Kinematic viscosity @ 100° C. (mm$^2$/s) | | 6.88 | 6.48 | 6.3 | 2.85 | 2.75 | 6.09 | 5.74 | 5.71 |
| Apparent VI | | 389 | 641 | 704 | 109 | 107 | 392 | 570 | 645 |

Example 2

Various samples of lubricating oil composition were prepared, in the same way as in Example 1, by weighing out into a beaker, in order, the high-viscosity constituents, additives, control constituents and low-viscosity constituents as shown below, and mixing them. Tables 2 and 3 show the compositions of the various combinations using the high-viscosity constituents and control constituents, as well as the separation temperature and the kinematic viscosities (40° C. and 100° C.)

TABLE 2

| | | 2-1 | 2-2 | 2-3 | 2-4 | 2-5 | 2-6 | 2-7 | 2-8 |
|---|---|---|---|---|---|---|---|---|---|
| Low-viscosity constituent | Base oil 3 | 50 | | 50 | | 50 | | 50 | |
| | Base oil 4 | | 50 | | 50 | | 50 | | 50 |
| Additives package | | 10 | 10 | 10 | 10 | 10 | 10 | 10 | 10 |
| Control constituent | Ester 1 | 20 | 20 | 20 | 20 | 20 | 20 | 20 | 20 |
| High-viscosity constituent | PAG 3 | 20 | 20 | | | | | | |
| | PAG 5 | | | 20 | 20 | | | | |
| | PAG 6 | | | | | 20 | 20 | | |
| | PAG 4 | | | | | | | 20 | 20 |
| Separation temperature (° C.) | | 47.1 | 40.9 | 79.4 | 72.1 | 82.0 | 79.2 | 79.8 | 65.4 |
| Kinematic viscosity @ 40° C. ($mm^2/s$) | | 24.94 | 23.62 | 22.27 | 22.61 | 21.69 | 22.02 | 22.93 | 21.81 |
| Kinematic viscosity @ 100° C. ($mm^2/s$) | | 7.160 | 7.103 | 8.432 | 8.455 | 7.781 | 7.986 | 9.425 | 9.204 |
| Apparent VI | | 278 | 295 | 402 | 396 | 375 | 380 | 439 | 453 |

TABLE 3

| | | 2-9 | 2-10 | 2-11 | 2-12 | 2-13 | 2-14 |
|---|---|---|---|---|---|---|---|
| Low-viscosity Constituent | Base oil 1 | | | | 50 | 50 | 50 |
| | Base oil 2 | | | 50 | | | |
| | Base oil 3 | 50 | | | | | |
| | Base oil 4 | | 50 | | | | |
| Additives package | | 10 | 10 | 10 | 10 | 10 | 10 |
| Control Constituent | Ester 1 | 20 | 20 | 20 | | | |
| | Ester 2 | | | | 20 | | |
| | Ester 3 | | | | | 20 | |
| | Ester 4 | | | | | | 20 |
| High-viscosity Constituent | PAG 4 | | | 20 | 20 | 20 | 20 |
| | PAG 7 | 20 | 20 | | | | |
| Separation temperature (° C.) | | 94.0 | 87.8 | 53.0 | 48.4 | 70.8 | 66.5 |
| Kinematic viscosity @ 40° C. ($mm^2/s$) | | 19.70 | 19.00 | 16.94 | 14.22 | 25.27 | 21.75 |
| Kinematic viscosity @ 100° C. ($mm^2/s$) | | 3.973 | 3.897 | 5.914 | 6.721 | 8.168 | 9.032 |
| Apparent VI | | 94 | 95 | 350 | 531 | 331 | 446 |

Comparative Example 1

Lubricating oil compositions were prepared by following the disclosure of the example in WO96/11244 (Pages 28-29 of WO96/11244, Table 3, the second lubricating oil). Table 4 shows the composition of the combination of low-viscosity constituent and high-viscosity constituent cited in WO96/11244 which is the prior art, as well as the separation temperature and the kinematic viscosity at 100° C. The process in WO96/11244 does not use the control constituent of the present invention.

TABLE 4

| | | 1-1 | 1-2 | 1-3 | 1-4 | 1-5 | 1-6 | 1-7 |
|---|---|---|---|---|---|---|---|---|
| Low-viscosity constituent | Base oil 5 | 100 | 90 | 75 | 5 | 25 | 10 | 0 |
| High-viscosity constituent | PAG 10 | 0 | 10 | 25 | 50 | 75 | 90 | 100 |
| Separation temperature (° C.) | | | 77 | 92 | 95 | 81 | 25 | |
| Kinematic viscosity @ 100° C. ($mm^2/s$) | | 3.9 | 4.65 | 6.05 | 9.39 | 14.57 | 18.96 | 22.3 |

Comparative Example 2

Various samples of lubricating oil composition were prepared, in the same way as in Example 1, by weighing out into a beaker, in order, the high-viscosity constituents, additives, control constituents and base oils as shown below, and mixing them. The separation temperature and kinematic viscosities (40° C. and 100° C.) were measured.

TABLE 5

| | | 2-1 | 2-2 | 2-3 | 2-4 | 2-5 | 2-6 |
|---|---|---|---|---|---|---|---|
| Low-viscosity constituent | Base oil 1 | 50 | | | | | |
| | Base oil 2 | | | | | 50 | |
| | Base oil 3 | | 50 | | 50 | | |
| | Base oil 4 | | | 50 | | | 50 |
| Additives package | | 10 | 10 | 10 | 10 | 10 | 10 |
| Control constituent | Ester 1 | 20 | 20 | 20 | 20 | 20 | 20 |
| High-viscosity constituent | PAG 1 | 20 | 20 | | | | |
| | PAG 2 | | | 20 | | | |
| | PAG 8 | | | | 20 | 20 | |
| | PAG 9 | | | | | | 20 |
| Separation temperature (° C.) | | Mixed (25° C.) (without separation) | | | Undissolved (120° C.) (no mixing even when heated) | | |
| Kinematic viscosity @ 40° C. ($mm^2/s$) | | 15.55* | 25.61* | 24.57* | Since there was no mixing even when heated, not measured | | |
| Kinematic viscosity @ 100° C. ($mm^2/s$) | | 4.016 | 5.563 | 5.389 | | | |
| Apparent VI | | 167 | 164 | 163 | | | |

In the cases of (2-1) to (2-3), mixing was at 25° C., so that the kinematic viscosities at 40° C. and 100° C. of the mixed constituents were measured (marked *). In the cases of (2-4) to (2-6), there was no mixing even when heated to 120° C. and the two phases remained as they were, and so they were deemed not suitable as lubricating oils with the two-phase system of this invention and their kinematic viscosities were not measured.

Discussion (1) Presence or Absence of Control Constituent (Example 1 and Comparative Example 1)

According to the results of Example 1, with a two-phase lubricating oil composition such as in the invention it is possible, by adding to a low-viscosity constituent and a high-viscosity constituent an ester compound which is a control constituent, to vary the separation temperature while holding the kinematic viscosity at 100° C. at almost the same level. For example, it was possible in the cases of (1-1) to (1-3) in Example 1 to control oil separation within the range of from 50° C. to 69° C. while holding the kinematic viscosity at 100° C. to approximately 6.5 $mm^2/s$, in the cases of (1-4) and (1-5) in Example 1 to control oil separation within the range of from 69° C. to 100° C. while holding the kinematic viscosity at 100° C. to approximately 2.8 $mm^2/s$, and in the cases of (1-6) to (1-8) in Example 1 to control oil separation within the range of from 49° C. to 77° C. while holding the kinematic viscosity at 100° C. to approximately 6.0 $mm^2/s$. In other words, it was evident that when an ester compound was used as a control constituent, as well as the separation temperature decreasing, there was virtually no change in the kinematic viscosity (see FIG. 3).

In addition, when the amount of ester compound acting as a control constituent was made a positive amount [(1-1) and (1-2), (1-4) and 1-5) and (1-6) and (1-7) in Example 1], it was evident that the degree of reduction of the phase-transition temperature (separation temperature) increased as the amount of ester compound increased (from 5% to 20%). In these cases, too, there was virtually no change in kinematic viscosity. As the result of selecting the ester compound from several kinds in order to make mixing of the low-viscosity constituent and high-viscosity constituent easier, those with a suitable polarity were found, and as a result it was possible to mix both constituents at a lower temperature than in the case where no control constituent was added. Again, it was evident that there was no significant effect on the kinematic viscosity.

Figure 3:
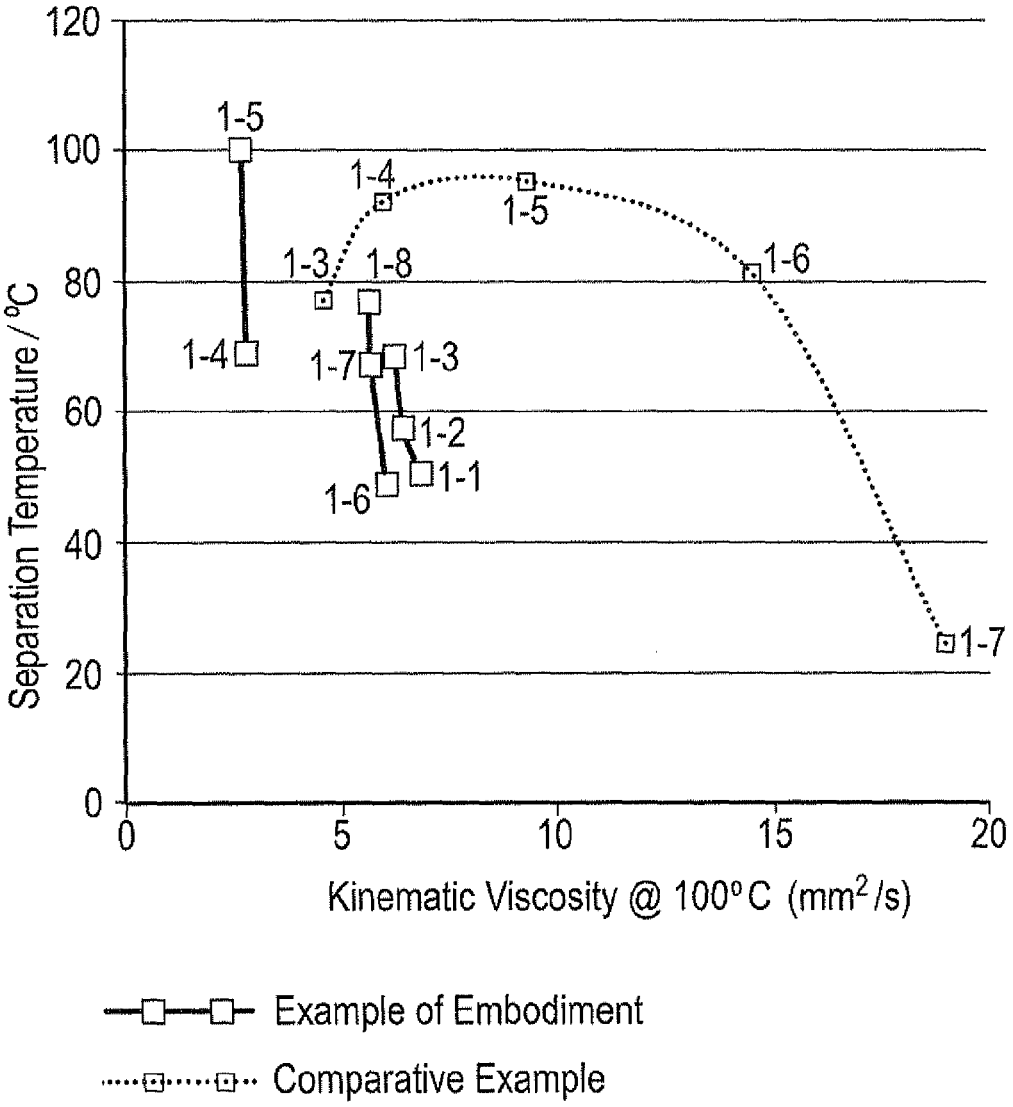
FIG. 3 shows the relationship between separation temperature and kinematic viscosity for the prior art and this invention.

On the other hand, in the case of the process described in WO96/11244 [(1-2) to (1-6) in Comparative Example 1], no control constituent was used, and only the proportions of high-viscosity constituent and low-viscosity constituent were changed. In that case, as shown in FIG. 3, by increasing the proportion of high-viscosity constituent, the kinematic viscosity at 100° C. becomes higher, but the separation temperature either becomes higher or becomes lower, unreliably showing large fluctuations, so that control of the kinematic viscosity and the separation temperature is extremely difficult, and it is difficult to obtain a lubricating oil composition that has a practical use.

(2) Comparison of High-Viscosity Constituent (Examples 1 and 2 and Comparative Example 1)

As in Examples 1 and 2, when a control constituent was used by adding it to a low-viscosity constituent and the high-viscosity constituents referred to as PAG 3, PAG 4, PAG 5, PAG 6 and PAG 7, the mixture merged into a single phase from two phases at a temperature between 40 and 100° C., so that it became double phase at low temperatures and single phase at high temperatures. Also, the kinematic viscosity at 100° C. of a mixture that became single phase remained between 2.5 and 15 $mm^2/s$, which means that it accorded with the aim of the invention, which is that no loss of oil film should occur in the high-temperature domain. The high-viscosity constituents that offer this effectiveness are believed to be those with a density of from 1.000 to 1.050 $g/cm^3$ and oxygen/carbon weight ratio of from 0.450 to 0.580.

On the other hand, as shown by Comparative Example 2, when using as the high-viscosity constituent a constituent with the low density of PAG 1 and PAG 2 and with a low oxygen/carbon weight ratio [(2-1) to (2-3) of the Comparative Example], the low-viscosity constituent and high-viscosity constituent are already mixed at the 25° C. stage before heating, and at low temperatures this does not accord with the aim of the invention in that it uses only the viscosity of the low-viscosity constituent which is normally in the upper phase. On the other hand, when using the high-viscosity constituents referred to as PAG 8 and PAG 9 which have high density and high oxygen/carbon weight ratio [(2-4) to (2-6) of the Comparative Example], even with heating up to 120° C., the low-viscosity constituent and high-viscosity constituent remain separated into two phases and are not mixed, so that the aim of using both the low-viscosity constituent and the high-viscosity constituent at high temperatures in the region of 100° C. is not achieved. Considering the domain of temperatures in which cars, industrial machinery and the like are used, the temperature at which there is separation into two phases is between 40° C. and 100° C., and it is desirable for there to be two phases below the oil separation temperature and one phase at temperatures higher than the separation temperature. In the cases of (2-1) to (2-6) in Comparative Example 2, given that the separation temperature lies outside this range, these do not accord with the aim of the invention.

That which is claimed is:

1. A lubricating oil composition comprising a mixture of:

(A) a hydrocarbon as a low-viscosity constituent, (B) a polyalkylene glycol (PAG) as a high-viscosity constituent wherein the oxygen/carbon weight ratio is in the range of from 0.450 to 0.580 and the density at 20° C. is in the range of from 1.000 to 1.050 g/cm$^3$, and (C) a compound as a control constituent wherein the compound comprises one or more ester groups and has an oxygen/carbon weight ratio in the range of from 0.080 to 0.350.

2. A lubricating oil composition in accordance with claim 1 wherein the low-viscosity constituent is selected from a poly α-olefin, a mineral oil, a GTL base oil, and mixtures thereof.

3. A lubricating oil composition in accordance with claim 1 wherein the control constituent is an aliphatic ester compound and the carbon chain other than in the ester group is C4 to C18.

4. A lubricating oil composition in accordance with claim 1 wherein the density of the low-viscosity constituent at 20° C. is in the range of from 0.750 to 0.950 g/cm$^3$.

5. A lubricating oil composition in accordance with claim 1 wherein the density of the control constituent at 20° C. is in the range of from 0.800 to 1.000 g/cm$^3$.

6. A lubricating oil composition in accordance with claim 1 wherein the kinematic viscosity at 40° C. of the low-viscosity constituent is in the range of from 5 to 500 mm$^2$/s.

7. A lubricating oil composition in accordance with claim 1 wherein the kinematic viscosity at 100° C. of the high-viscosity constituent is in the range of from 2.5 to 100 mm$^2$/s.

8. A lubricating oil composition in accordance with claim 1 wherein the kinematic viscosity at 100° C. is in the range of from 1.5 to 100 mm$^2$/s.

9. A lubricating oil composition in accordance with claim 1 wherein, relative to 100% by weight of the total composition, the blended proportion of the low-viscosity constituent is in the range of from 30 to 80% by weight, the blended proportion of the high-viscosity constituent is in the range of from 3 to 35% by weight, and the blended proportion of the control constituent is in the range of from 1 to 30% by weight.

10. A method comprising: applying a lubricating oil composition to a surface in relative movement to another surface, wherein the lubricating oil composition comprises a mixture of:

(A) a hydrocarbon as a low-viscosity constituent, (B) a polyalkylene glycol (PAG) as a high-viscosity constituent wherein the oxygen/carbon weight ratio is in the range of from 0.450 to 0.580 and the density at 20° C. is in the range of from 1.000 to 1.050 g/cm$^3$, and (C) a compound as a control constituent wherein the compound comprises one or more ester groups and has an oxygen/carbon weight ratio in the range of from 0.080 to 0.350.

11. A method in accordance with claim 10 wherein the surface is a surface of a rotating member or a sliding member in a vehicle or industrial machine.

12. A method in accordance with claim 10 wherein the surface is in an engine, a gear mechanism, a speed-change gearbox, a bearing, a hydraulic apparatus or compression machinery.

13. A method in accordance with claim 10 wherein the low-viscosity constituent is selected from a poly α-olefin, a mineral oil, a GTL base oil, and mixtures thereof.

14. A method in accordance with claim 10 wherein the control constituent is an aliphatic ester compound and the carbon chain other than in the ester group is C4 to C18.

15. A method in accordance with claim 10 wherein the density of the low-viscosity constituent at 20° C. is in the range of from 0.750 to 0.950 g/cm$^3$.

16. A method in accordance with claim 10 wherein the density of the control constituent at 20° C. is in the range of from 0.800 to 1.000 g/cm$^3$.

17. A method in accordance with claim 10 wherein the kinematic viscosity at 40° C. of the low-viscosity constituent is in the range of from 5 to 500 mm$^2$/s.

18. A method in accordance with claim 10 wherein the kinematic viscosity at 100° C. of the high-viscosity constituent is in the range of from 2.5 to 100 mm$^2$/s.

19. A method in accordance with claim 10 wherein the kinematic viscosity at 100° C. is in the range of from 1.5 to 100 mm$^2$/s.

20. A method in accordance with claim 10 wherein, relative to 100% by weight of the total composition, the blended proportion of the low-viscosity constituent is in the range of from 30 to 80% by weight, the blended proportion of the high-viscosity constituent is in the range of from 3 to 35% by weight, and the blended proportion of the control constituent is in the range of from 1 to 30% by weight.

* * * * *